US012589833B2

(12) United States Patent
Gu et al.

(10) Patent No.: US 12,589,833 B2
(45) Date of Patent: Mar. 31, 2026

(54) VENTILATION DRAG REDUCTION DEVICE AND MARINE VENTILATION DRAG REDUCTION SYSTEM INCLUDING SAME

(71) Applicants: JIANGSU UNIVERSITY OF SCIENCE AND TECHNOLOGY, Zhenjiang (CN); MARINE EQUIPMENT AND TECHNOLOGY INSTITUTE OF JUST, Zhenjiang (CN); CHINA MERCHANTS JINLING SHIPBUILDING (JIANGSU) CO., LTD., Zhenjiang (CN)

(72) Inventors: Jiayang Gu, Zhenjiang (CN); Weifa Liu, Zhenjiang (CN); Zhongyu Zhang, Zhenjiang (CN); Guorong Li, Yizheng (CN); Tao Huang, Yizheng (CN); Jishun Qu, Zhenjiang (CN); Yanwu Tao, Zhenjiang (CN); Ji Zhou, Zhenjiang (CN)

(73) Assignees: JIANGSU UNIVERSITY OF SCIENCE AND TECHNOLOGY, Zhenjiang (CN); MARINE EQUIPMENT AND TECHNOLOGY INSTITUTE OF JUST, Zhenjiang (CN); CHINA MERCHANTS JINLING SHIPBUILDING (JIANGSU) CO., LTD., Yizheng (CN)

( * ) Notice: Subject to any disclaimer, the term of this patent is extended or adjusted under 35 U.S.C. 154(b) by 391 days.

(21) Appl. No.: 18/218,623

(22) Filed: Jul. 6, 2023

(65) Prior Publication Data

US 2023/0348022 A1 Nov. 2, 2023

(30) Foreign Application Priority Data

Jul. 8, 2022 (CN) ..... 202210799535.4

(51) Int. Cl.
*B63B 1/38* (2006.01)

(52) U.S. Cl.
CPC ..... *B63B 1/38* (2013.01)

(58) Field of Classification Search
CPC ..... B63B 1/38; B63B 2001/382; B63B 2001/385; B63B 2001/387
See application file for complete search history.

(56) References Cited

U.S. PATENT DOCUMENTS

2011/0107956 A1* 5/2011 Takano ..... B63B 59/04 114/67 A

FOREIGN PATENT DOCUMENTS

WO WO-2020204606 A1 * 10/2020 ..... B63B 1/38

* cited by examiner

*Primary Examiner* — Andrew Polay
(74) *Attorney, Agent, or Firm* — CBM PATENT CONSULTING, LLC

(57) ABSTRACT

A ventilation drag reduction device includes a main housing, a first rectification assembly, a second rectification assembly, and a flow isolating assembly; the main housing is composed of a first segment, a second segment, a third segment, and a fourth segment; the first rectification assembly is composed of first rectification plates; the second rectification assembly is composed of at least one second rectification plate; the flow isolating assembly is arranged in a cavity of the third segment; the fourth segment is configured as an outlet end. On the premise that the total construction cost is not obviously increased, high-pressure gas is rectified in a cavity of the main housing, so that the turbidity of the high-pressure gas is reduced, and a stable insulating gas layer is formed at the bottom of a hull; in addition, the present invention further discloses a marine ventilation drag reduction system.

1 Claim, 6 Drawing Sheets

VENTILATION DRAG REDUCTION DEVICE AND MARINE VENTILATION DRAG REDUCTION SYSTEM INCLUDING SAME

CROSS-REFERENCE TO RELATED APPLICATIONS

This application claims priority to Chinese Patent Application Ser. No. CN2022107995354 filed on 8 Jul. 2022.

TECHNICAL FIELD

The present invention relates to the technical field of shipbuilding, and particularly relates to a ventilation drag reduction device and a marine ventilation drag reduction system including the same.

BACKGROUND ART

With the increasing requirements of the International Maritime Organization (IMO) for energy conservation and emission reduction, the Energy Efficiency Design Index (EEDI) and the Energy Efficiency Existing Ship Index (EEXI) are becoming more and more stringent, and reducing ship energy consumption has become a development trend of the ship industry. Ventilation drag reduction technology is one of the cutting-edge technologies with remarkable energy-saving effect for ships and underwater vehicles, and is increasingly valued by the ship industry.

Ventilation drag reduction technology utilizes the physical property that the viscosity coefficient of gas is much smaller than that of water. A gas layer is formed on the surface of the ship after the gas passes through a ventilation device, thereby reducing the wetted surface area of the ship, and effectively reducing the frictional resistance of underwater navigation, so that the fuel economy effect is improved, and the comprehensive energy consumption of the ship is reduced, and the emissions of harmful gases such as carbides, sulfides, and nitrides are reduced.

At present, ventilation drag reduction technology has been widely applied to the field of ships. For example, Chinese invention patent CN216468300U discloses a marine ventilation drag reduction system that uses branch pipelines to adjust a gas volume. As shown in FIG. 1, the system includes a gas supply device, a gas transmission device, a plurality of pressure stabilizing chambers, a controller, a detection device, a control valve unit, and a plurality of nozzle holes arranged on the bottom plate of a ship; the gas supply device is connected with the gas transmission device; the gas transmission device is connected with each pressure stabilizing chamber, and configured to transmit the gas outputted by the gas supply device to each pressure-stabilizing chamber; the pressure-stabilizing chambers are arranged at the bottom of the ship, extend in a width direction of the ship and are distributed at certain intervals in a length direction of the ship, and each pressure-stabilizing chamber is connected with a plurality of nozzle holes and configured to eject the gas out of the nozzle holes from the gas transmission device; the controller is connected with the detection device and the control valve unit; the control valve unit is arranged on the gas transmission device, the detection device arranged on the gas transmission device is configured to detect the gas flow and pressure value inputted by the gas transmission device into each pressure-stabilizing chamber and then transmit the gas flow and pressure value to the controller, and the controller is configured to control the opening of the control valve unit according to the gas flow and pressure value, so as to control the amount of gas inputted by the gas transmission device into each pressure-stabilizing chamber. In this way, it can effectively ensure that the injection volume of each pressure-stabilizing chamber reaches the optimal distribution state, so that the expected goal of low-resistance navigation of the ship can be achieved. However, the detection device (the gas flow and pressure value in the pressure-stabilizing chamber are recorded and reported in real time), the control valve unit, and the controller need to work together to stabilize the pressure value in the pressure-stabilizing chamber, the design structure is complex, the implementation is difficult, and the construction investment is huge (estimated to be RMB 800,000-1,200,000). More importantly, the complexity of the system structure is positively correlated with the probability of failure. In view of this, in the actual operation of the ship, it is necessary to spend a lot of manpower and material resources for routine inspection and maintenance. Therefore, it is urgent for the research group to solve the above problems.

SUMMARY

Therefore, in view of the above existing problems and defects, the research group of the present invention, on the basis of collecting relevant data, making various evaluations and considerations, and organizing continuous experiments and revisions, finally developed a ventilation drag reduction device.

In order to solve the above technical problems, the present invention relates to a ventilation drag reduction device that is installed at a position flush with the bottom of a hull to form an insulating gas layer on the bottom of the hull. The ventilation drag reduction device includes a main housing, a first rectification assembly, a second rectification assembly, and a flow isolating assembly. Along a direction from left to right, the main housing is composed of a first segment, a second segment, a third segment, and a fourth segment that are sequentially connected and communicated from end to end. Along a direction from left to right, the longitudinal cross-sectional areas of the first segment and the third segment remain unchanged, while the longitudinal cross-sectional areas of the second segment and the fourth segment tend to be smaller. The first segment is configured as an inlet end, and a top wall thereof is provided with an air inlet. The first rectification assembly is composed of a plurality of first rectification plates vertically arranged in a cavity of the second segment and spaced apart in a left-right direction. A plurality of first ventilation holes are evenly distributed on the first rectification plate. The second rectification assembly is composed of at least one second rectification plate vertically arranged in a cavity of the third segment. A plurality of second ventilation holes are formed on the second rectification plate near a top wall thereof. The flow isolating assembly is arranged in a cavity of the third segment and located on the right left side of the second rectification assembly. The flow isolating assembly is composed of a plurality of flow isolating plates that are all parallel to the second rectification plate and are displaced from each other along the up-down direction. The fourth segment is configured as an outlet end, and a bottom wall thereof is provided with an air outlet.

As a further improvement of the technical solution of the present invention, the ventilation drag reduction device further includes a rectification filler. The rectification filler is embedded in the cavity of the third segment, and is provided with a rectification flow channel which completely penetrates along its length direction. Along a gas flow direction, the rectification flow channel is sequentially composed of a contraction cavity, a horizontal constant section cavity, and a down-folded exhaust cavity.

As a further improvement of the technical solution of the present invention, the ventilation drag reduction device further includes a deflection plate. The deflection plate is hinged in the rectification filler to communicate or block the horizontal constant section cavity and the down-folded exhaust cavity. In a working state, high-pressure gas is continuously supplied to the air inlet, and the deflection plate performs a deflection motion under the action of an external gas thrust to communicate the horizontal constant section cavity and the down-folded exhaust cavity. In a non-working state, the supply of high-pressure gas to the air inlet is suspended, and the deflection plate is reset under the action of gravity to block the horizontal constant section cavity and the down-folded exhaust cavity.

As a further improvement of the technical solution of the present invention, corresponding to the horizontal constant section cavity, an inclined limit wall is formed in the down-folded exhaust cavity. The deflection angle of the deflection plate is controlled between 0° and 60°. And when the deflection plate is horizontal against the inclined limit wall, the deflection angle of the deflection plate is 60°.

As a further improvement of the technical solution of the present invention, the top wall of the fourth segment is arc-shaped, and the arc radius r is controlled at 300-350 cm.

As a further improvement of the technical solution of the present invention, the ventilation drag reduction device further includes a flow stabilizing assembly. The flow stabilizing assembly is arranged in the cavity of the fourth segment, and consists of a plurality of first horizontal flow stabilizing plates, second horizontal flow stabilizing plates, and third horizontal flow stabilizing plates that are displaced from and parallel to each other in a left-right direction. The first horizontal flow stabilizing plate and the third horizontal flow stabilizing plate are both fixed on a right side wall of the second rectification plate, and are kept in a non-abutting state with the top wall of the fourth segment. The second horizontal flow stabilizing plate is fixed on the top wall of the fourth segment, and is kept in a non-abutting state with the second rectification plate.

Compared with a ventilation drag reduction device of the traditional design structure, the ventilation drag reduction device in the technical solution disclosed in the present invention features a special circulation path of high-pressure gas as follows: air inlet-first rectification assembly-flow isolating assembly-second rectification assembly-air outlet-bottom of the hull. On the premise that the total construction cost is not obviously increased, high-pressure gas is rectified under the synergistic effect of the first rectification assembly, the flow isolating assembly, and the second rectification assembly in the circulating process in a cavity of the main housing, so that the turbulivity of the high-pressure gas discharged instantly through an air outlet is reduced, and a lasting and stable insulating gas layer is easy to be formed at the bottom of a hull, thereby reducing the frictional resistance of the ship when navigating in water, and finally improving its fuel economy.

More importantly, effective rectification of high-pressure gas can be realized by relying on the design structure characteristics of the ventilation drag reduction device, without need of a water flow sensor, a pressure sensor, a controller, and so forth involved in the prior art. As a result, the overall design structure of the ventilation drag reduction device is extremely simple, and easy to manufacture and implement. In particular, during the operation of the ship, routine maintenance is not required unless in case of any structural damage.

In addition, the present invention further discloses a marine ventilation drag reduction system. The system includes a high-pressure gas source, a main pipeline, a main stop valve, N branch pipelines, N secondary stop valves, N throttle valves, and N ventilation drag reduction devices mentioned above. Each ventilation drag reduction device is communicated with the high-pressure gas source through its corresponding branch pipelines and main pipeline in sequence. The main stop valve is matched with the main pipeline to communicate or block the high-pressure gas source and the main pipeline. The secondary stop valve is matched with the branch pipeline to communicate or block the branch pipeline and the ventilation drag reduction device. The throttle valve is matched with the branch pipeline to increase or decrease the amount of high-pressure gas supplied to the ventilation drag reduction device through the branch pipeline in unit time.

As a further improvement of the technical solution of the present invention, the marine ventilation drag reduction system further includes N liquid level sensors. The secondary stop valve is preferably an electromagnetic stop valve. The liquid level sensor is configured to control the switching of the open/closed state of the secondary stop valve, and is matched with the ventilation drag reduction device to sense whether there is any water in an inner cavity of the main housing in real time.

As a further improvement of the technical solution of the present invention, the high-pressure gas source is preferably an electric gas pump, an air compressor or a high-pressure gas storage tank.

Based on the above technical solution, the same high-pressure gas source, and one main pipeline, gas supply for a plurality of ventilation drag reduction devices can be achieved at the same time, thereby reducing the amount of ship renovation works, greatly reducing the construction cost, and shortening the renovation period. In addition, the throttle valve can be configured to quickly and efficiently adjust the amount of high-pressure gas supplied by the corresponding ventilation drag reduction device, so as to ensure that the high-pressure gas can be kept in the optimal distribution state according to the actual sailing conditions of the ship, so that a stable insulating gas layer can be formed at the bottom of the hull, the effect of drag reduction is finally achieved, and the design purpose of energy conservation and emission reduction for ship navigation is realized.

BRIEF DESCRIPTION OF THE DRAWINGS

In order to more clearly describe the technical solutions in the examples of the present disclosure or in the prior art, a brief introduction to the accompanying drawings required for the description of the examples or the prior art will be made below. Apparently, the accompanying drawings in the following description are merely some embodiments of the present invention, and those of ordinary skill in the art would also be able to derive other drawings from these drawings without making creative efforts.

Figure 1:
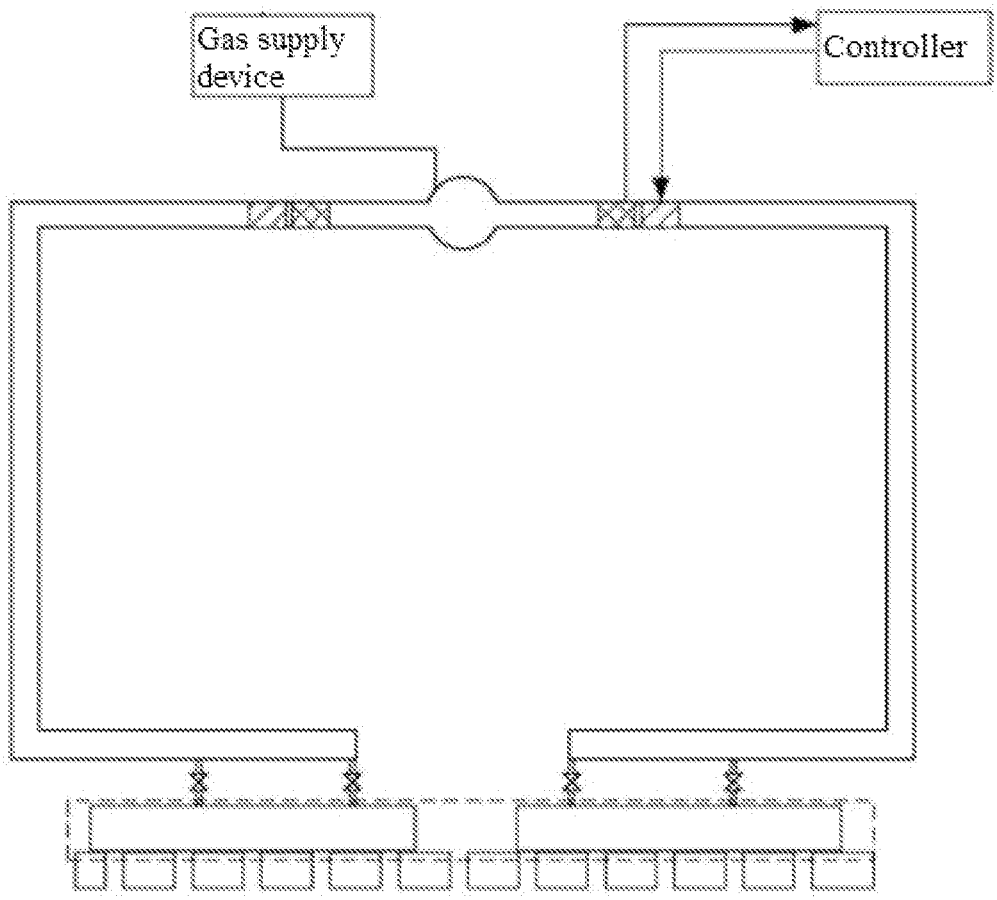
FIG. 1 is a schematic diagram of the structure of a marine ventilation drag reduction system in the prior art.

1—high-pressure gas storage tank; 2—main pipeline; 3—main stop valve; 4—branch pipeline; 5—secondary stop valve; 6—throttle valve; 7—ventilation drag reduction device; 71—main housing; 711—first segment; 7111—air inlet; 712—second segment; 713—third segment; 714—fourth segment; 7141—air outlet; 72—first rectification assembly; 721—first rectification plate; 7211—first ventilation hole; 73—second rectification assembly; 731—second rectification plate; 7311—second ventilation hole; 74—flow isolating assembly; 741—flow isolating plate; 75—rectification filler; 751—rectification flow channel; 7511—contraction cavity; 7512—horizontal constant section cavity; 7513—down-folded exhaust cavity; 75131—inclined limit wall; 76—deflection plate; 77—flow stabilizing assembly; 771—first horizontal flow stabilizing plate; 772—second horizontal flow stabilizing plate; and 773—third horizontal flow stabilizing plate.

DETAILED DESCRIPTION OF THE EMBODIMENTS

In the description of the present invention, it should be noted that orientation or position relationships indicted by the terms "front", "rear", "up", "down", "left", "right" and the like are based on orientation or position relationships shown in the drawings, merely for the convenience of describing the present invention and simplifying the description, rather than indicating or implying that the indicated device or element must have particular orientations or be constructed and operated in particular orientations. Therefore, these terms should not be construed as a limitation to the protection scope of the present invention.

Figure 2:
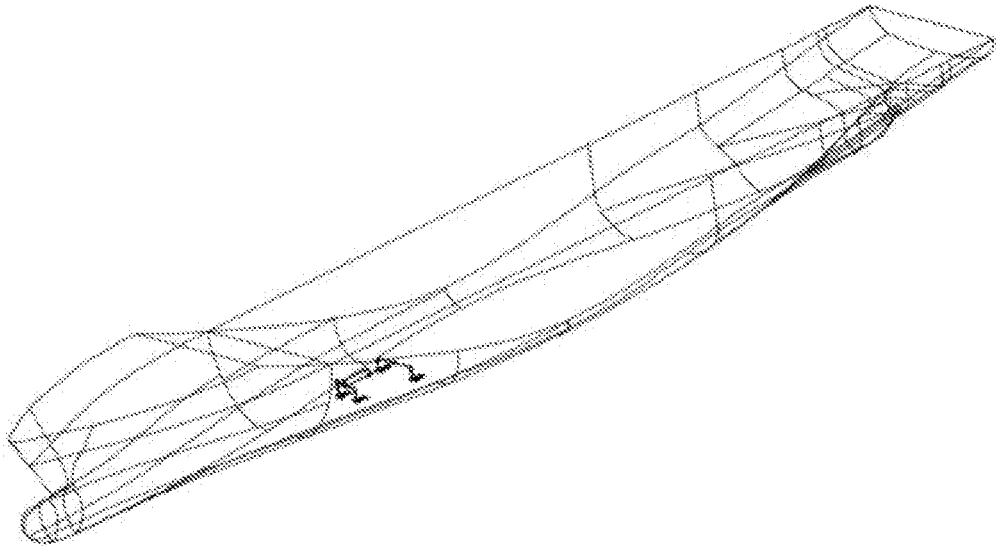
FIG. 2 is a schematic diagram of an application state of a marine ventilation drag reduction system of the present invention when the system is matched with a ship.

The content disclosed in the present invention will be further described in detail below in conjunction with specific embodiments. FIG. 2 shows an application state of a marine ventilation drag reduction system of the present invention when the system is matched with a ship. It can be seen that the marine ventilation drag reduction system is matched with the ship to form a stable insulating gas layer at the bottom of a hull, so as to lay a good foundation for reducing the frictional resistance of the ship when navigating in water.

Figure 3:
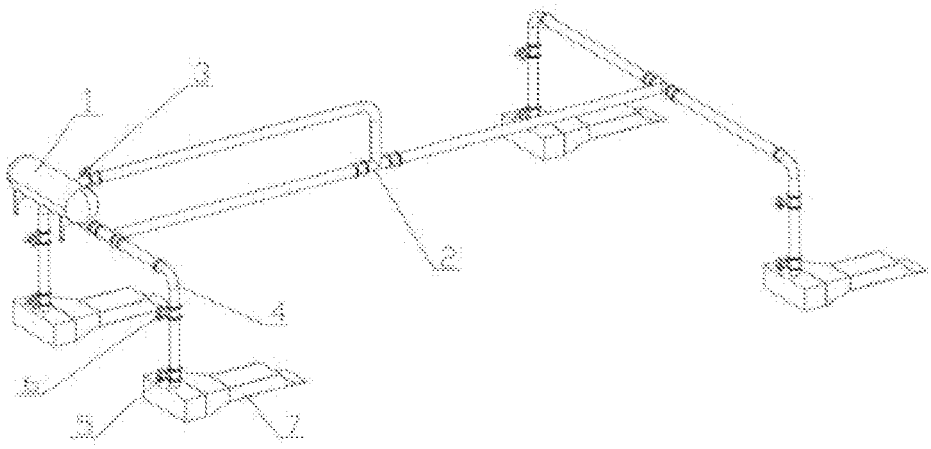
FIG. 3 is a schematic diagram of the structure of the marine ventilation drag reduction system of the present invention.

FIG. 3 is a schematic diagram of the structure of the marine ventilation drag reduction system of the present invention. It can be seen that the system is mainly composed of a high-pressure gas storage tank 1, a main pipeline 2, a main stop valve 3, 4 branch pipelines 4, 4 secondary stop valves 5, 4 throttle valves 6, and 4 ventilation drag reduction devices 7. Each ventilation drag reduction device 7 is installed at a position flush with the bottom of the hull and communicated with the high-pressure gas storage tank 1 through its corresponding branch pipeline 4 and main pipeline 2 in sequence. The main stop valve 3 is matched with the main pipeline 2 to communicate or block the high-pressure gas storage tank 1 and the main pipeline 2. The secondary stop valve 5 is matched with the branch pipeline 4 to communicate or block the branch pipeline 4 and the corresponding ventilation drag reduction device 7. The throttle valve 6 is matched with the branch pipeline 4 to increase or decrease the amount of high-pressure gas supplied to the ventilation drag reduction device 7 through the branch pipeline 4 in unit time. Based on the above technical solution, the same high-pressure gas storage tank 1, and one main pipeline 2, gas supply for a plurality of ventilation drag reduction devices 7 can be achieved at the same time, thereby reducing the amount of ship renovation works, greatly reducing the construction cost, and shortening the renovation period.

More importantly, when sea conditions change, that is, when the water velocity and direction change, the crew, by changing the opening/closing degree of the throttle valve 6, can quickly and efficiently adjust the amount of high-pressure gas supplied by the corresponding ventilation drag reduction device 7, so as to ensure that the high-pressure gas can be kept in the optimal distribution state between the ventilation drag reduction devices 7 according to the actual sailing conditions of the ship, so that a lasting and stable insulating gas layer is finally formed at the bottom of the hull.

When the ship is actually sailing, the phenomenon of saltwater intrusion is very likely to occur due to the damage of the ventilation drag reduction device 7, which in turn affects the normal operation and performance of the marine ventilation drag reduction system. In order to solve this problem, the present invention adopts an initial design scheme that each branch pipeline 4 is equipped with a one-way valve, which only allows one-way flow of high-pressure gas. However, in actual use, at the moment when the one-way valve is closed, part of the high-pressure gas flows in the opposite direction, and as the valve clack closing process continues, the backflow velocity of the high-pressure gas rapidly drops from the maximum to zero, while the pressure rises rapidly, that is, a "water hammer" phenomenon that may have a destructive effect on the branch pipeline 4 will occur, resulting in that the service life of the branch pipeline 4 is seriously reduced, and a large amount of manpower and material resources will be required to perform replacement operations later. In view of this, as another modified design of the above technical solution, the marine ventilation drag reduction system can also be additionally provided with 4 liquid level sensors (not shown in the figure). And the secondary stop valve 5 is preferably an electromagnetic stop valve. The working principle is as follows: when the power is turned on, a coil generates an electromagnetic force to lift a closure member from a seat of the valve, and then the valve is opened to communicate the branch pipeline 4 and the main pipeline 2; when the power is turned off, the electromagnetic force disappears, a spring force presses the closure member on the seat of the valve, and then the valve is closed to block the branch pipeline 4 and the main pipeline 2. The liquid level sensor is configured to control the switching of the open/closed state of the secondary stop valve, and is matched with the ventilation drag reduction device 7 to sense whether there is any water in an inner cavity thereof in real time. In a specific application, when the inner cavity of the ventilation drag reduction device 7 is invaded by water, and when the liquid level sensor is immersed by water, it can immediately sense the existence of water and send a control command to the electromagnetic stop valve in order to perform the closing operation, and the circulation path of the branch pipeline 4 and the main pipe 2 will be blocked, so that the phenomenon of saltwater intrusion can be effectively avoided, and the phenomenon that service life of the branch pipeline 4 is greatly shortened due to the "water hammer effect" can also be avoided.

The following two points need to be explained here: 1) in addition to the above high-pressure gas storage tank 1 that can be used as a gas source for the ventilation drag reduction device 7, other high-pressure gas sources, such as an electric gas pump and an air compressor can also be selected according to customer needs and actual sea conditions; 2) according to customer needs and actual sea conditions, the matching number and specific installation positions of the ventilation drag reduction devices 7 can also be adjusted, so that a lasting and stable insulating gas layer is finally formed at the bottom of the hull when the ship sails at a high speed.

Figure 4:
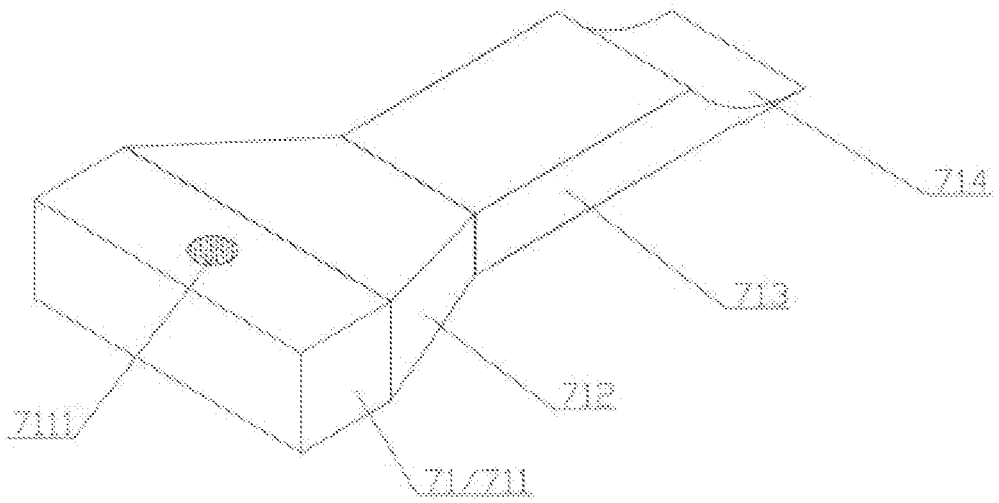
FIG. 4 is a three-dimensional schematic diagram of a ventilation drag reduction device in a first embodiment of the present invention from one perspective.
Figure 5:
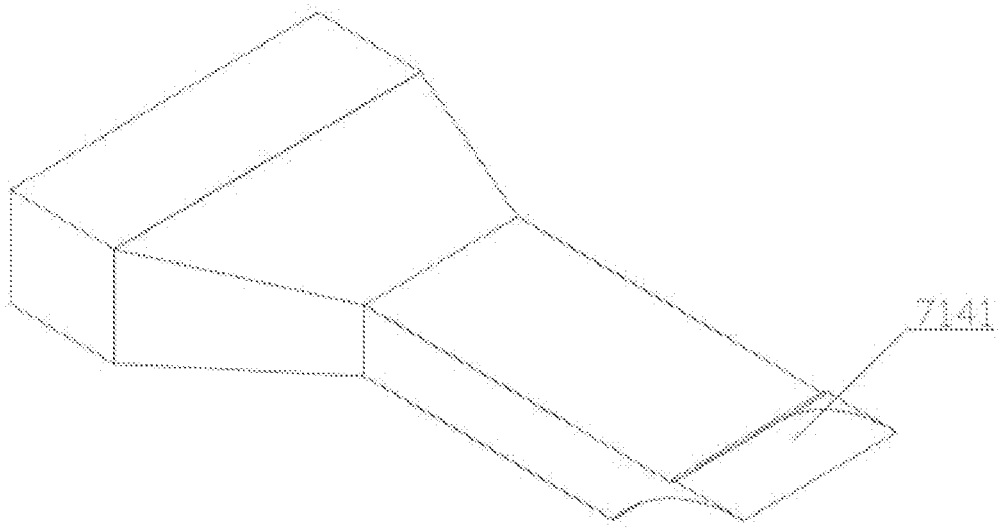
FIG. 5 is a three-dimensional schematic diagram of the ventilation drag reduction device in a first embodiment of the present invention from another perspective.
Figure 6:
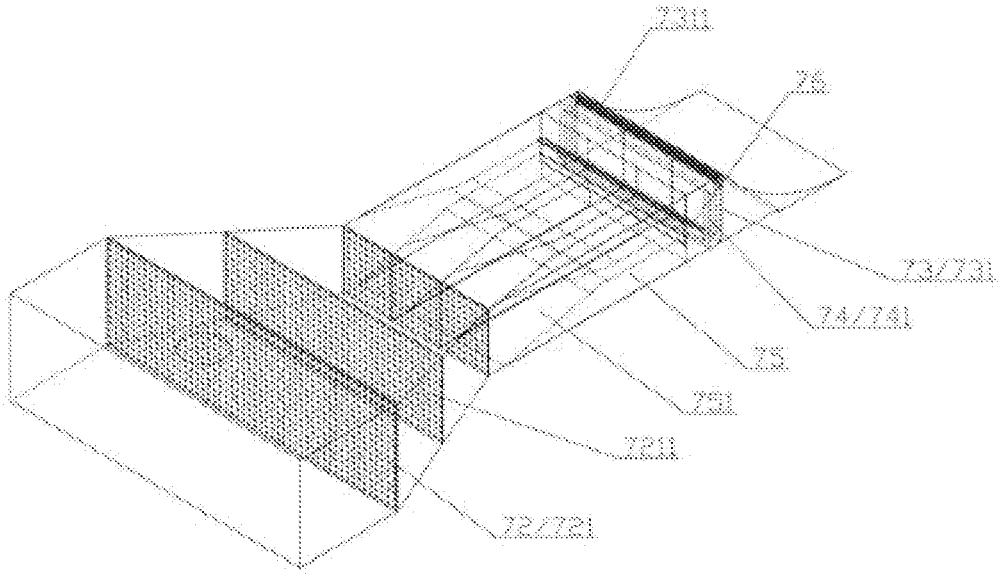
FIG. 6 is a three-dimensional schematic diagram of the ventilation drag reduction device in a first embodiment of the present invention (in the state where a hidden line is visible).
Figure 7:
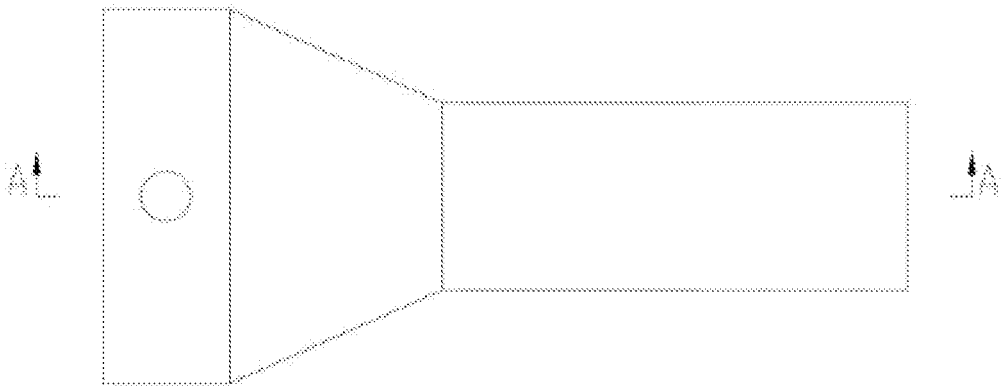
FIG. 7 is a top view of FIG. 4.
Figure 8:
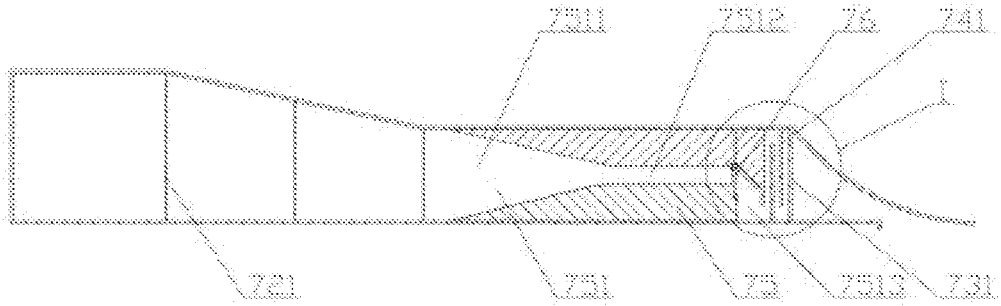
FIG. 8 is a cross-sectional view of A-A in FIG. 7.
Figure 9:
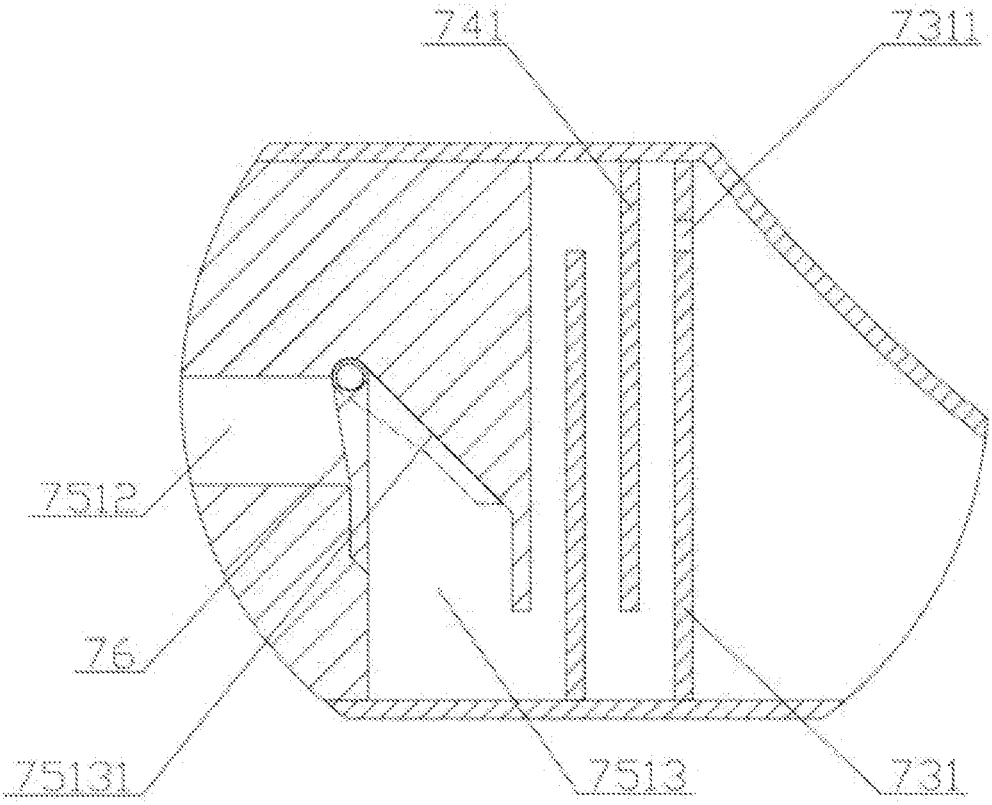
FIG. 9 is a partially enlarged diagram of part I in FIG. 8.

FIG. 4 and FIG. 5 respectively are three-dimensional schematic diagrams of the ventilation drag reduction device in a first embodiment of the present invention from two perspectives. It can be seen that the device is mainly composed of a main housing 71, a first rectification assembly 72, a second rectification assembly 73, a flow isolating assembly 74, and the like. Along a direction from left to right, the main housing 71 is composed of a first segment 711, a second segment 712, a third segment 713, and a fourth segment 714 that are sequentially connected and communicated from end to end. Along a direction from left to right, the longitudinal cross-sectional areas of the first segment 711 and the third segment 713 remain unchanged, while the longitudinal cross-sectional areas of the second segment 712 and the fourth segment 714 tend to be smaller. The first segment 711 is configured as an inlet end, and a top wall thereof is provided with an air inlet 7111. The first rectification assembly 72 is composed of 3 first rectification plates 721 vertically arranged in a cavity of the second segment 712 and spaced apart in a left-right direction. A plurality of first ventilation holes 7211 are evenly distributed on the first rectification plate 721. The second rectification assembly 73 is composed of at least one second rectification plate 731 vertically arranged in a cavity of the third segment 713. A plurality of second ventilation holes 7311 are formed on the second rectification plate 731 near a top wall thereof. The flow isolating assembly 74 is arranged in a cavity of the third segment 713 and located on the right left side of the second rectification assembly 73. The flow isolating assembly 74 is composed of 2 flow isolating plates 741 that are all parallel to the second rectification plate 731 and are displaced from each other along the up-down direction. The rectification plate 741 on the left is in a vertical state, is fixed on a bottom wall of the cavity of the third segment 713, and is kept in a non-abutting state with a top wall thereof (the gap is controlled at 5-8 cm). The rectification plate 741 on the right is fixed on a top wall of the cavity of the third segment 713, and is kept in a non-abutting state with a bottom wall thereof (the gap is controlled at 5-8 cm). The fourth segment 714 is configured as an outlet end, and a bottom wall thereof is provided with an air outlet 7141 (as shown in FIGS. 6-9).

In practical applications, the circulation path of high-pressure gas as follows: air inlet 7111-first rectification assembly 72-flow isolating assembly 74-second rectification assembly 73-air outlet 7141-bottom of the hull. The working principle is described in detail as follows: first, when the high-pressure gas flows into the second segment 712 through the first segment 711, because a plurality of first rectification plates 721 are arranged at intervals in the cavity of the second segment 712, and also the longitudinal cross-sectional areas thereof in the circulation direction tend to be smaller, the turbulivity of the high-pressure gas can be effectively reduced. In the process that the high-pressure gas flows through the third segment 713, under the synergistic effect of the rectification plates 741, the high-pressure gas is capable to follow a "polygonal" path to cross the flow isolating assembly 74, and then the high-pressure gas flows into the fourth segment 714, which is also affected by the fact that the longitudinal cross-sectional area thereof tends to be smaller along the circulation direction, so that the turbulivity of the high-pressure gas is further reduced, and it is ensured that the flow velocity of the gas in different distribution areas tends to be consistent when the gas is ejected through the air outlet 7141, thereby facilitating the subsequent formation of a stable and lasting insulating gas layer at the bottom of the ship.

In practical applications, the above ventilation drag reduction device has achieved at least the following beneficial effects, specifically including:

1) on the premise that the total construction cost is not obviously increased, high-pressure gas is rectified under the synergistic effect of the first rectification assembly 72, the flow isolating assembly 74, and the second rectification assembly 73 in the circulating process in a cavity of the main housing 71, so that the turbulivity of the high-pressure gas discharged instantly through an air outlet 7141 is reduced, and a lasting and stable insulating gas layer is easy to be formed at the bottom of a hull, thereby reducing the frictional resistance of the ship when navigating in water, and finally improving its fuel economy; and
2) effective rectification of high-pressure gas can be realized by relying on the design structure characteristics of the ventilation drag reduction device 7, and the overall design structure of the ventilation drag reduction device 7 is extremely simple, and easy to manufacture and implement; in particular, during the operation of the ship, routine maintenance is not required unless in case of any structural damage of the ventilation drag reduction device 7.

Furthermore, it can be clearly seen in combination with the accompanying drawings 4, 5 and 6 that the top wall of the fourth segment 714 is preferably designed to be arc-shaped, and the arc radius r is controlled at 300-350 cm. As a result, when the high-pressure gas is discharged through the air outlet 7141, it is drained by the arc, which leads to the optimization in the injection direction, thereby facilitating the subsequent formation of a stable and continuous insulating gas layer in the area close to the bottom wall of the ship.

Furthermore, with reference to the accompanying drawings 6-9, it can also be known that a rectification filler 75 is embedded in the cavity of the third segment 713. The rectification filler 75 is provided with a rectification flow channel 751 which completely penetrates along its length direction. Along a gas flow direction, the rectification flow channel 751 is sequentially composed of a contraction cavity 7511, a horizontal constant section cavity 7512, and a down-folded exhaust cavity 7513. In practical applications, when the high-pressure gas passes through the contraction cavity 7511, the pressure of the high-pressure gas also decreases as the cross-sectional area gradually decreases, but the flow velocity increases sharply. In this case, a vacuum is very likely to be generated at an inlet of the contraction cavity 7511, which in turn causes more high-pressure gas to be sucked into the contraction cavity 7511. In this way, the vibration intensity of the airflow can be effectively reduced, and the "turbulence" phenomenon of the high-pressure gas flowing through the rectification filler 75 can be avoided, so that the turbulivity of the high-pressure gas can be greatly reduced.

When the high-pressure gas storage tank 1 is not opened, seawater is easily poured back into the branch pipeline 4 and the main pipeline 2 through the ventilation drag reduction device 7, inevitably resulting in that the service life of both is seriously reduced, and a lot of manpower and material resources are required for replacement in the later stage. In view of this, as a further optimization of the structure of the above ventilation drag reduction device, a deflection plate 76 is additionally added, as shown in FIGS. 6-9. Adjacent to its outlet end, the deflection plate 76 is freely and pendularly hinged on the top wall of the horizontal constant section cavity 7512, to communicate or block the horizontal constant section cavity 7512 and the down-folded exhaust cavity 7513. In a working state, high-pressure gas is continuously supplied to the air inlet 7111, and the deflection plate 76 performs a deflection motion under the action of an external gas thrust to communicate the horizontal constant section cavity 7512 and the down-folded exhaust cavity 7513. Corresponding to the horizontal constant section cavity 7512, an inclined limit wall 75131 is formed in the down-folded exhaust cavity 7513. The deflection angle of the deflection plate 76 is controlled between 0° and 60°. And when the deflection plate 76 is horizontal against the inclined limit wall 75131, the deflection angle of the deflection plate 76 is 60°. In a non-working state, the supply of high-pressure gas to the air inlet 7111 is suspended, and the deflection plate 76 is reset under the action of gravity to block the horizontal constant section cavity 7512 and the down-folded exhaust cavity 7513. In this way, the phenomenon that the seawater is poured back into the branch pipeline 4 and the main pipeline 2 through the ventilation drag reduction device 7 can be effectively avoided, and finally the working performance of the marine ventilation drag reduction system can be ensured normally and efficiently.

Figure 10:
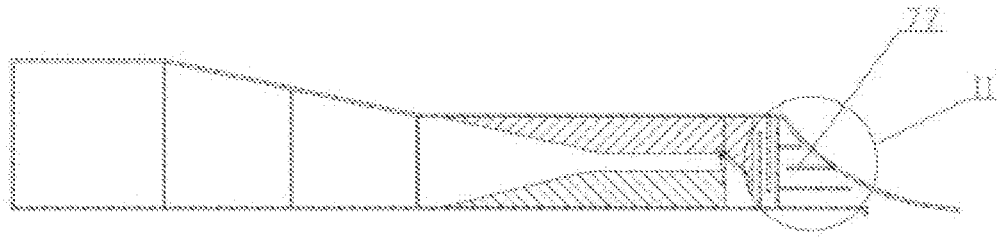
FIG. 10 is a schematic diagram of the structure of the ventilation drag reduction device in a second embodiment of the present invention.
Figure 11:
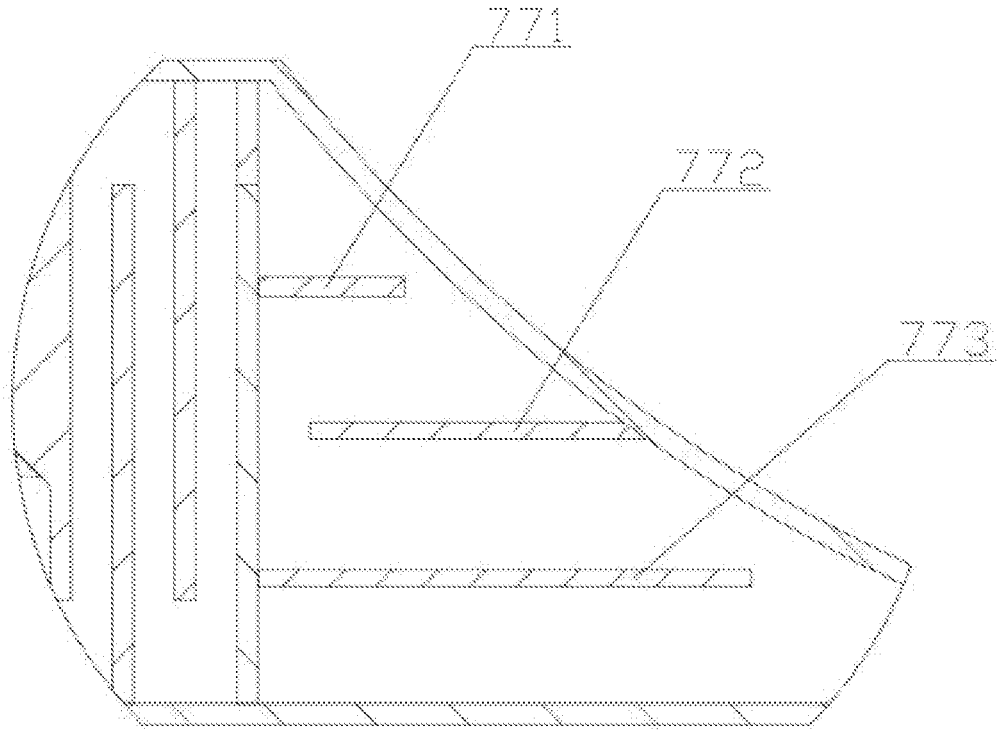
FIG. 11 is a partially enlarged diagram of part II in FIG. 10.

FIG. 10 is a schematic diagram of the structure of the ventilation drag reduction device in a second embodiment of the present invention. It can be seen that the difference between the second embodiment and the above first embodiment is that a cavity of the fourth segment 714 is additionally provided with a flow stabilizing assembly 77. As shown in FIG. 11, the flow stabilizing assembly 77 consists of first horizontal flow stabilizing plates 771, second horizontal flow stabilizing plates 772, and third horizontal flow stabilizing plates 773 that are displaced from and parallel to each other in a left-right direction. The first horizontal flow stabilizing plate 771 and the third horizontal flow stabilizing plate 773 are both fixed on a right side wall of the second rectification plate 731, and are kept in a non-abutting state with the top wall of the fourth segment 714. The second horizontal flow stabilizing plate 772 is fixed on the top wall of the fourth segment 714, and is kept in a non-abutting state with the second rectification plate 731. In this way, when the rectified high-pressure gas flows into the cavity of the fourth segment 714 via the second rectification plate 731, under the synergistic effect of the first horizontal flow stabilizing plate 771, the second horizontal flow stabilizing plate 772, and the third horizontal flow stabilizing plate 773, the high-pressure gas circulates along the "polygonal" path, which can further reduce the probability of the occurrence of "turbulence" and ensure that the flow velocity of the gas in different distribution areas tends to be consistent when the gas is ejected through the air outlet 7141, thereby facilitating the subsequent formation of a stable and lasting insulating gas layer at the bottom of the ship.

The above description of the disclosed embodiments enables any person skilled in the art to implement or use the present invention. Various modifications to these embodiments will be readily apparent to those skilled in the art, and the generic principles defined herein may be implemented in other embodiments without departing from the spirit or scope of the present invention. Thus, the present invention is not intended to be limited to the embodiments shown herein, but is to be accorded with the widest scope consistent with the principles and novel features disclosed herein.

What is claimed is:

1. A ventilation drag reduction device that is installed at a position flush with the bottom of a hull to form an insulating gas layer on the bottom of the hull, comprising a main housing, a first rectification assembly, a second rectification assembly, and a flow isolating assembly, wherein: along a direction from left to right, the main housing is composed of a first segment, a second segment, a third segment, and a fourth segment that are sequentially connected and communicated from end to end; along a direction from left to right, the longitudinal cross-sectional areas of the first segment and the third segment remain unchanged, while the longitudinal cross-sectional areas of the second segment and the fourth segment tend to be smaller; the first segment is configured as an inlet end, and a top wall thereof is provided with an air inlet; the first rectification assembly is composed of a plurality of first rectification plates vertically arranged in a cavity of the second segment and spaced apart in a left-right direction; a plurality of first ventilation holes are evenly distributed on the first rectification plate; the second rectification assembly is composed of at least one second rectification plate vertically arranged in a cavity of the third segment; a plurality of second ventilation holes are formed on the second rectification plate near a top wall thereof; the flow isolating assembly is arranged in a cavity of the third segment and located on the right left side of the second rectification assembly; the flow isolating assembly is composed of a plurality of flow isolating plates that are all parallel to the second rectification plate and are displaced from each other along the up-down direction; the fourth segment is configured as an outlet end, and a bottom wall thereof is provided with an air outlet;

the ventilation drag reduction device further includes a rectification filler; the rectification filler is embedded in the cavity of the third segment, and is provided with a rectification flow channel which completely penetrates along its length direction; along a gas flow direction, the rectification flow channel is sequentially composed of a contraction cavity, a horizontal constant section cavity, and a down-folded exhaust cavity;

the ventilation drag reduction device further includes a deflection plate; the deflection plate is hinged in the rectification filler to communicate or block the horizontal constant section cavity and the down-folded exhaust cavity; in a working state, high-pressure gas is continuously supplied to the air inlet, and the deflection plate performs a deflection motion under the action of an external gas thrust to communicate the horizontal constant section cavity and the down-folded exhaust cavity; in a non-working state, the supply of high-pressure gas to the air inlet is suspended, and the deflection plate is reset under the action of gravity to block the horizontal constant section cavity and the down-folded exhaust cavity;

corresponding to the horizontal constant section cavity, an inclined limit wall is formed in the down-folded exhaust cavity; the deflection angle of the deflection plate is controlled between 0° and 60°; and when the deflection plate is horizontal against the inclined limit wall, the deflection angle of the deflection plate is 60°;

the top wall of the fourth segment is arc-shaped, and the arc radius r is controlled at 300-350 cm; and the ventilation drag reduction device further includes a flow stabilizing assembly; the flow stabilizing assembly is arranged in the cavity of the fourth segment, and consists of a plurality of first horizontal flow stabilizing plates, second horizontal flow stabilizing plates, and third horizontal flow stabilizing plates that are displaced from and parallel to each other in a left-right direction; the first horizontal flow stabilizing plate and the third horizontal flow stabilizing plate are both fixed on a right side wall of the second rectification plate, and are kept in a non-abutting state with the top wall of the fourth segment; and the second horizontal flow stabilizing plate is fixed on the top wall of the fourth segment, and is kept in a non-abutting state with the second rectification plate.

* * * * *